US006899966B2

(12) United States Patent
Benum et al.

(10) Patent No.: US 6,899,966 B2
(45) Date of Patent: May 31, 2005

(54) COMPOSITE SURFACE ON A STAINLESS STEEL MATRIX

(75) Inventors: Leslie Wilfred Benum, Red Deer (CA); Michael C. Oballa, Cochrane (CA); Sabino Steven Anthony Petrone, Edmonton (CA)

(73) Assignee: Nova Chemicals (International) S.A. (CH)

( * ) Notice: Subject to any disclaimer, the term of this patent is extended or adjusted under 35 U.S.C. 154(b) by 122 days.

(21) Appl. No.: 10/602,238

(22) Filed: Jun. 24, 2003

(65) Prior Publication Data

US 2004/0265604 A1 Dec. 30, 2004

(51) Int. Cl.[7] ..... B32B 15/18; B32B 9/00

(52) U.S. Cl. ..... 428/702; 428/638; 428/682; 428/684; 428/469; 428/336; 428/701; 428/697; 428/699; 585/648; 427/421; 427/446; 427/124; 427/255.23; 427/566; 427/593; 106/286.2; 106/286.8

(58) Field of Search ..... 428/638, 682, 428/684, 469, 336, 701–702, 697, 699; 585/648; 106/286.2, 286.8; 427/421, 446, 124, 255.23, 566, 593

(56) References Cited

U.S. PATENT DOCUMENTS

| | | | | |
|---|---|---|---|---|
| 5,630,887 A | 5/1997 | Benum et al. | ..... | 148/280 |
| 6,436,202 B1 | 8/2002 | Benum et al. | ..... | 148/276 |

FOREIGN PATENT DOCUMENTS

| | | | | |
|---|---|---|---|---|
| CA | 1028601 | | 3/1978 | |
| JP | 55-141545 | * | 11/1980 | ..... C22C/38/22 |
| JP | 57019179 B | | 4/1982 | |
| WO | WO 22905 A2 | | 3/2002 | |
| WO | WO 22908 A2 | | 3/2002 | |
| WO | WO 22910 A2 | | 3/2002 | |

OTHER PUBLICATIONS

Translation of JP–55–141545.*

* cited by examiner

*Primary Examiner*—Deborah Jones
*Assistant Examiner*—Ling Xu
(74) *Attorney, Agent, or Firm*—Kenneth H. Johnson

(57) ABSTRACT

A composite surface having a thickness from 10 to 5,000 microns comprising a spinel of the formula $Mn_xCr_{3-x}O_4$ wherein x is from 0.5 to 2 and oxides of Mn, Si selected from the group consisting of MnO, $MnSiO_3$, $Mn_2SiO_4$ and mixtures thereof which are not prone to coking and are suitable for hydrocarbyl reactions such as furnace tubes for cracking.

46 Claims, 3 Drawing Sheets

COMPOSITE SURFACE ON A STAINLESS STEEL MATRIX

FIELD OF THE INVENTION

The present invention relates to a composite surface useful on a steel substrate, particularly stainless steel. The present invention provides a composite surface on steels which provides enhanced materials protection (e.g. protects the steel substrate or matrix). The composite surface reduces coking in applications where the steel is exposed to a hydrocarbon environment at elevated temperatures. Such stainless steel may be used in a number of applications, particularly in the processing of hydrocarbons and in particular in pyrolysis processes such as the dehydrogenation of alkanes to olefins (e.g. ethane to ethylene); reactor tubes for cracking hydrocarbons; or reactor tubes for steam cracking or reforming.

BACKGROUND OF THE INVENTION

It has been known for some time that the surface composition of a metal alloy may have a significant impact on its utility. It has been known to treat steel to produce an iron oxide layer that is easily removed. It has also been known to treat steel to enhance its wear resistance. The use of stainless steels has heretofore relied upon the protection (e.g. against corrosion and other forms of material degradation) afforded by a chromia surface. As far as Applicants are aware there is not a significant amount of art on treating steels to significantly reduce coking in hydrocarbon processing. There is even less art on the types of surface that reduce coking significantly in hydrocarbon processing.

There has been experimental work related to the nuclear industry that spinels similar to those of the present invention can be generated as outer stainless steel surfaces. However, these spinels are thermo-mechanically unstable and tend to delaminate. This is a limitation which tends to teach against using such surfaces commercially. These surfaces have been evaluated for use in the nuclear industry but to Applicants' knowledge have never been commercially used.

In the petrochemical industry due to its thermo-mechanical limitations spinels similar to those used in the present invention are believed to be overall less protective than chromia. It is also believed from a coke make perspective spinels similar to those used in the present invention are not considered to be more catalytically inert than chromia. Due to these teachings, to Applicants' knowledge, such spinels have not been produced nor recommended for use in the petrochemical industry.

Canadian Patent 1,028,601 issued Mar. 28, 1978 to Bagnoli et al., assigned to Exxon Research and Engineering Company discloses a high nickel (e.g. 36–38 weight %) high chromium (e.g. 23–27 weight %) steel, comprising from 1.25 to 2 weight % manganese, and the balance substantially iron. The surface of the steel may be oxidized in steam at temperatures in the range from 500° F. (160° C.) to about 2000° F. (1093.3° C.). The patent teaches that there is a protective coating of manganese and chromium oxide (chromic oxide or chromia $Cr_2O_3$) formed on the interior of the pipe. The reference teaches away from the formation of a chromium-manganese spinel ($MnCr_2O_4$). Further, the reference fails to teach the formation of oxides of manganese and/or silica selected from the group consisting of MnO, $MnSiO_3$, $Mn_2SiO_4$ and mixtures thereof nor their use as an outer coating of a composite surface.

The abstract of Japanese Patent 57019179B teaches a ferric stainless steel comprising 16–19 weight % of Cr, 0.75–1.25 weight % of Mo, optionally copper and carbon$\leqq$0.12 weight %, Ni$\leqq$0.013, Si and Mn$\leqq$0.1, S$\leqq$0.01 weight %; is coated with a thin film of $Cr_2O_3$ having a thickness greater than or equal to 50 nm containing $MnCr_2O_4$ with or without $MnSiO_3$. The abstract fails to teach the composite films of the present invention having a surface coating of oxides of Mn and/or Si selected from the group consisting of MnO, $MnSiO_3$, $Mn_2SiO_4$ and mixtures thereof. The resulting surfaces have improved resistance to corrosion. The reference is silent about the resistance of the surface to coking.

U.S. Patent 5,630,887 issued May 20, 1997 to Benum et al. (assigned to Novacor Chemicals Ltd. (now NOVA Chemicals Corporation)) teaches the treatment of stainless steel to produce a surface layer having a total thickness from about 20 to 45 microns, comprising from 15 to 25 weight % of manganese and from about 60 to 75 weight % of chromium. Clearly the patent requires the presence of both manganese and chromium in the surface layer but does not teach a spinel nor oxides of Mn (e.g. MnO) and/or oxides of manganese and silicon (e.g. $MnSiO_3$ and $Mn_2SiO_4$).

U.S. Patent 6,436,202 B1 issued Aug. 20, 2002 to Benum et al. (assigned to NOVA Chemicals (International) S.A.) and WO 02/22910; WO 02/22908 and WO 02/22905 teach a high chrome steel treated in an oxidizing atmosphere to produce a surface predominantly of a spinel of the formula $Mn_yCr_{3-x}O_4$ wherein x is from 0.5 to 2. The reference fails to teach a surface which further comprises Mn, Si, oxides selected from the group consisting of MnO, $MnSiO_3$, $Mn_2SiO_4$ and mixtures thereof.

The present invention seeks to provide a novel surface structure having good resistance to coking.

SUMMARY OF THE INVENTION

Figure 1:
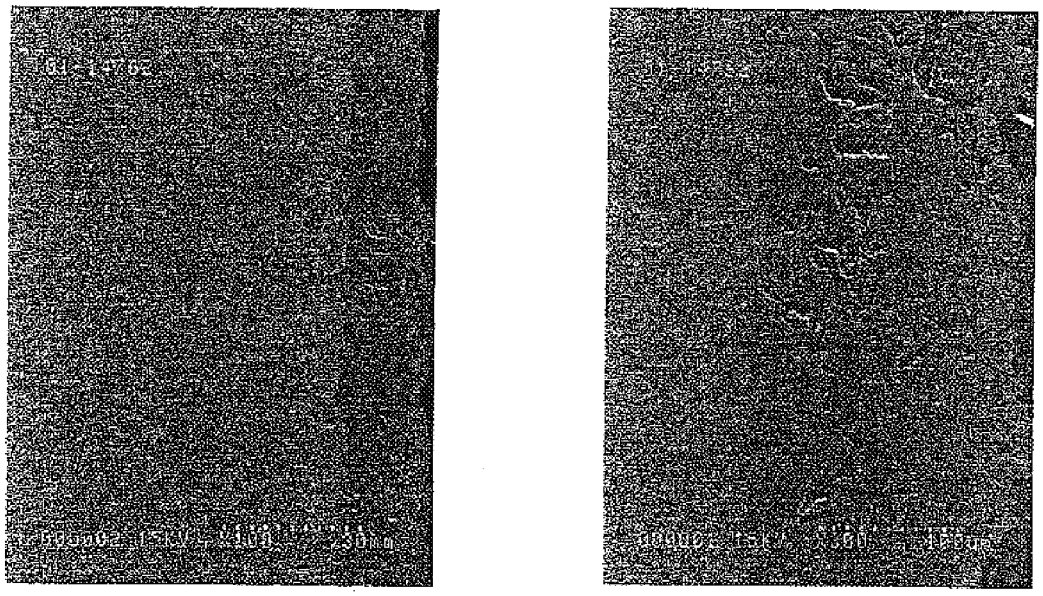
FIG. 1 is an SEM micrograph of Example 2.

The present invention provides on a steel substrate a surface having a thickness from 10 to 5,000 microns comprising from 90 to 10 preferably from 40 to 60 weight % of the compounds of the formula $Mn_xCr_{3-x}O_4$ wherein x is from 0.5 to 2 and from 10 to 90 preferably from 60 to 40 weight % of oxides of Mn and Si selected from the group consisting of MnO, $MnSiO_3$, $Mn_2SiO_4$ and mixtures thereof. Preferably $Cr_2O_3$ is absent but if present it is present in an amount of less than 5, preferably less than 2, most preferably less than 0.5 weight % of the surface.

The present invention further provides a method of applying a composition comprising from 90 to 10 weight % of compounds of the formula $Mn_xCr_{3-x}O_4$ wherein x is from 0.5 to 2 and from 10 to 90 weight % of oxides of Mn and Si selected from the group consisting of MnO, $MnSiO_3$, $Mn_2SiO_4$ and mixtures thereof provided that the composition contains less than 5 weight % of $Cr_2O_3$ to at least a portion of a steel substrate comprising applying said composition by a method selected from the group consisting of detonation gun spraying, cement packing, hard facing, laser cladding, plasma spraying, physical vapor deposition methods, flame spraying, and electron beam evaporation to at least 70% of the selected surface of the steel substrate to provide a thickness from 0.1 to 5,000 microns.

In a further embodiment the present invention provides a stainless steel article such as a pipe or tube, a reactor, or a heat exchanger having at least a portion of its inner surface comprising the above composite surface.

In a further embodiment the present invention provides the use of such equipment, particularly in environments where coking is likely to occur such as cracking of hydrocarbons or steam reforming.

DETAILED DESCRIPTION

In a number of industries and particularly the chemical industry stainless substrates are used to form equipment (e.g. furnace tubes, steam reforming reactors, heat exchangers and reactors) used in harsh environments which may result in coking of the stainless steel surface. In the ethylene furnace industry the furnace tubes may be a single tube or tubes and fittings welded together to form a coil which may be subject to coke build-up (coking).

The substrate may be any material to which the composite coating will bond. The substrate may be a carbon steel or a stainless steel which may be selected from the group consisting of wrought stainless, austentic stainless steel and HP, HT, HU, HW and HX stainless steel, heat resistant steel, and nickel based alloys. The substrate may be a high strength low alloy steel (HSLA); high strength structural steel or ultra high strength steel. The classification and composition of such steels are known to those skilled in the art.

In one embodiment the stainless steel, preferably heat resistant stainless steel typically comprises from 13 to 50, preferably 20 to 50, most preferably from 20 to 38 weight % of chromium. The stainless steel may further comprise from 20 to 50, preferably from 25 to 50 most preferably from 25 to 48, desirably from about 30 to 45 weight % of Ni. The balance of the stainless steel is substantially iron.

The present invention may also be used with nickel and/or cobalt based extreme austentic high temperature alloys (HTAs). Typically the alloys comprise a major amount of nickel or cobalt. Typically the high temperature nickel based alloys comprise from about 50 to 70, preferably from about 55 to 65 weight % of Ni; from about 20 to 10 weight % of Cr; from about 20 to 10 weight % of Co; and from about 5 to 9 weight % of Fe and the balance one or more of the trace elements noted below to bring the composition up to 100 weight %. Typically the high temperature cobalt based alloys comprise from 40 to 65 weight % of Co; from 15 to 20 weight % of Cr; from 20 to 13 weight % of Ni; less than 4 weight % of Fe and the balance one or more trace elements as set out below and up to 20 weight % of W. The sum of the components adding up to 100 weight %.

In some embodiments of the invention the substrate may further comprise at least 0.2 weight %, up to 3 weight % typically 1.0 weight %, up to 2.5 weight % preferably not more than 2 weight % of manganese from 0.3 to 2, preferably 0.8 to 1.6 typically less than 1.9 weight % of Si; less than 3, typically less than 2 weight % of titanium, niobium (typically less than 2.0, preferably less than 1.5 weight % of niobium) and all other trace metals; and carbon in an amount of less than 2.0 weight %.

The surface has a thickness from about 10 to 5,000 microns typically from 10 to 2,000, preferably from 10 to 1,000 desirably from 10 to 500 microns. Typically the substrate surface covers at least about 70%, preferably 85%, most preferably not less than 95%, desirably not less than 98.5% of the surface of the stainless steel substrate.

The surface and the compositions used to prepare the surface comprise from 90 to 10 weight %, preferably from 60 to 40 weight %, most preferably from 45 to 55 weight % the spinel (e.g. $Mn_xCr_{3-x}O_4$ wherein x is from 0.5 to 2) and from 10 to 90 weight %, preferably form 40 to 60 weight %, most preferably from 55 to 45 weight % of oxides of Mn, Si selected from the group consisting of MnO, $MnSiO_3$, $Mn_2SiO_4$ and mixtures thereof.

If the oxide has a nominal stoichiometry of MnO the Mn may be present in the surface in an amount from 1 to 50 atomic %. Where the oxide is $MnSiO_3$, the Si may be present in the surface in an amount from 1 to 50 atomic %. If the oxide is $Mn_2SiO_4$, the Si may be present in the surface in an amount from 1 to 50 atomic %.

The surface and the compositions used to prepare the surface should comprise less than 5, preferably less than 2, most preferably less than 0.5 weight % of $Cr_2O_3$. Most preferably $Cr_2O_3$ is absent in the surface or the compositions used to prepare the surface.

The compositions used to prepare the surface may be applied to the surface of the metal substrate or selected portions of the surface of the selected substrate (e.g. the interior where the interior is likely to be subjected to coking conditions such as a furnace tube or the exterior where the exterior is likely to be subjected to coking conditions such as a heat exchanger) using conventional deposition processes. The substrate may be any metal to which the composition will adhere, preferably bond (chemically). The substrate may be a carbon steel or a stainless steel which may be selected from the group consisting of wrought stainless, austentic stainless steel and HP, HT, HU, HW and HX, stainless steel, heat resistant steel, and HTA nickel and cobalt based alloys. The substrate may be a high strength low alloy steel (HSLA); high strength structural steel or ultra high strength steel. The substrate may also be high temperature materials including but not limited to superalloys and intermetallic alloys. The classification and composition of such steels are known to those skilled in the art.

The constituents of the surface composite which can be in the form of a powder may be used per se as a coating composition in conventional coating processes including detonation gun spraying, cement packing, hard facing, laser cladding, plasma spraying (e.g. low pressure plasma spraying), physical vapour deposition methods (PVD including cathodic arc sputtering, DC, RF, magnetron), flame spraying (e.g. high pressure/high velocity Oxygen Fuel (HP/HVOF), and electron beam evaporation. Combinations of these methods may also be used. Typically a powder having the targeted composition is applied to the substrate.

The composite surface may also be subjected to a heating process (which may be concurrent with or subsequent to the deposition process) at temperatures which result in the formation of a layer or alloy of the targeted surface composition. In some instances there may be diffusion of elements from the substrate into the composite surface coating. There may be a subsequent finishing/processing stage to realizing a selected balance of properties. For example, if mechanical robustness is a targeted property, the deposition stage (e.g. the composition) may include materials that can interdiffuse into the matrix and match Coefficients of Thermal Expansion (CTE). Reliance on outward diffusion from the steel into the spinel is limiting and may not provide materials that can wet the surface composition. One factor which may limit these types of treatments is the temperatures which the substrate can withstand and maintain physical integrity.

The steel substrate may be forged, rolled or cast. In one embodiment of the invention the steel is in the form of pipes or tubes. The tubes have an internal composite surface in accordance with the present invention, These tubes may be used in petrochemical processes such as cracking of hydrocarbons and in particular the cracking of ethane, propane, butane, naphtha, and gas oil, or mixtures thereof or steam reforming typically of $C_{3-6}$ preferably $C_{4-6}$ hydrocarbons such as isobutane to isobutylene, typically in the presence of a catalysts. The stainless steel may be in the form of a reactor or vessel having an interior composite surface in accordance with the present invention. The stainless steel may be in the form of a heat exchanger in which either or both of the internal and/or external surfaces are composite surfaces in accordance with the present invention. Such heat exchangers may be used to control the enthalpy of a fluid passing in or over the heat exchanger.

A particularly useful application for the composite surfaces of the present invention is in furnace tubes or pipes used for the cracking of alkanes (e.g. ethane, propane, butane, naphtha, and gas oil, or mixtures thereof) to olefins (e.g. ethylene, propylene, butene, etc.). Generally in such an operation a feedstock (e.g. ethane) is fed in a gaseous form to a tube, pipe or coil typically having an outside diameter ranging from 1.5 to 8 inches (e.g. typical outside diameters are 2 inches about 5 cm; 3 inches about 7.6 cm; 3.5 inches about 8.9 cm; 6 inches about 15.2 cm and 7 inches about 17.8 cm). The tube or pipe runs through a furnace generally maintained at a temperature from about 900° C. to 1100° C. and the outlet gas generally has a temperature from about 800° C. to 900° C. As the feedstock passes through the furnace it releases hydrogen (and other byproducts) and becomes unsaturated (e.g. ethylene). The typical operating conditions such as temperature, pressure and flow rates for such processes are well known to those skilled in the art, The present invention will now be illustrated by the following non-limiting examples.

EXAMPLE 1

SEM/EDS Analyses Results of Coatings

A number of coatings were prepared on a substrates of stainless steel. Scanning Electron Microscopy/Energy Dispersive Spectroscopy (SEM/EDS) analyses of the composition of the coatings were carried out using an Hitachi S-2500 SEM fitted with an Oxford EDS system. The results of EDS analyses of typical coatings are shown in Table 1.

TABLE 1

Coating Compositions by EDS Analysis (wt %)

| | Coating System | | |
|---|---|---|---|
| Element | $MnCr_2O_4$ | MnO—Mn | MnO—Mn—Si |
| Mn | 24.1% | 77.0% | 15.8% |
| Cr | 45.9% | — | — |
| O | 29.0% | 22.7% | 46.4% |
| Si | 0.2% | 0.2% | 33.6% |
| Al | 0.5% | 0.1% | 3.7% |
| Zr | 0.5% | — | — |
| Ni | — | — | — |
| Fe | — | — | — |
| Other | — | — | 0.6% |
| | 100% | 100% | 100% |

EXAMPLE 2

Metallographic Cross-Section of Spinel $MnCr_2O_4$-Based Coating (SEM Microraphs at Magnifications of 100× and 300×)

A sample of austenitic stainless steel having the composite surface of the present invention w as metallographically mounted and polished using standard techniques, carbon coated and imaged using Secondary Electron Microscopy as shown in FIG. 1.

The figure clearly shows that there is a surface composition different from the substrate and it is well bonded to the substrate through a bond-layer.

EXAMPLE 3

X-ray Diffraction Analysis of Spinel $MnCr_2O_4$-Based Coating

Figure 2:
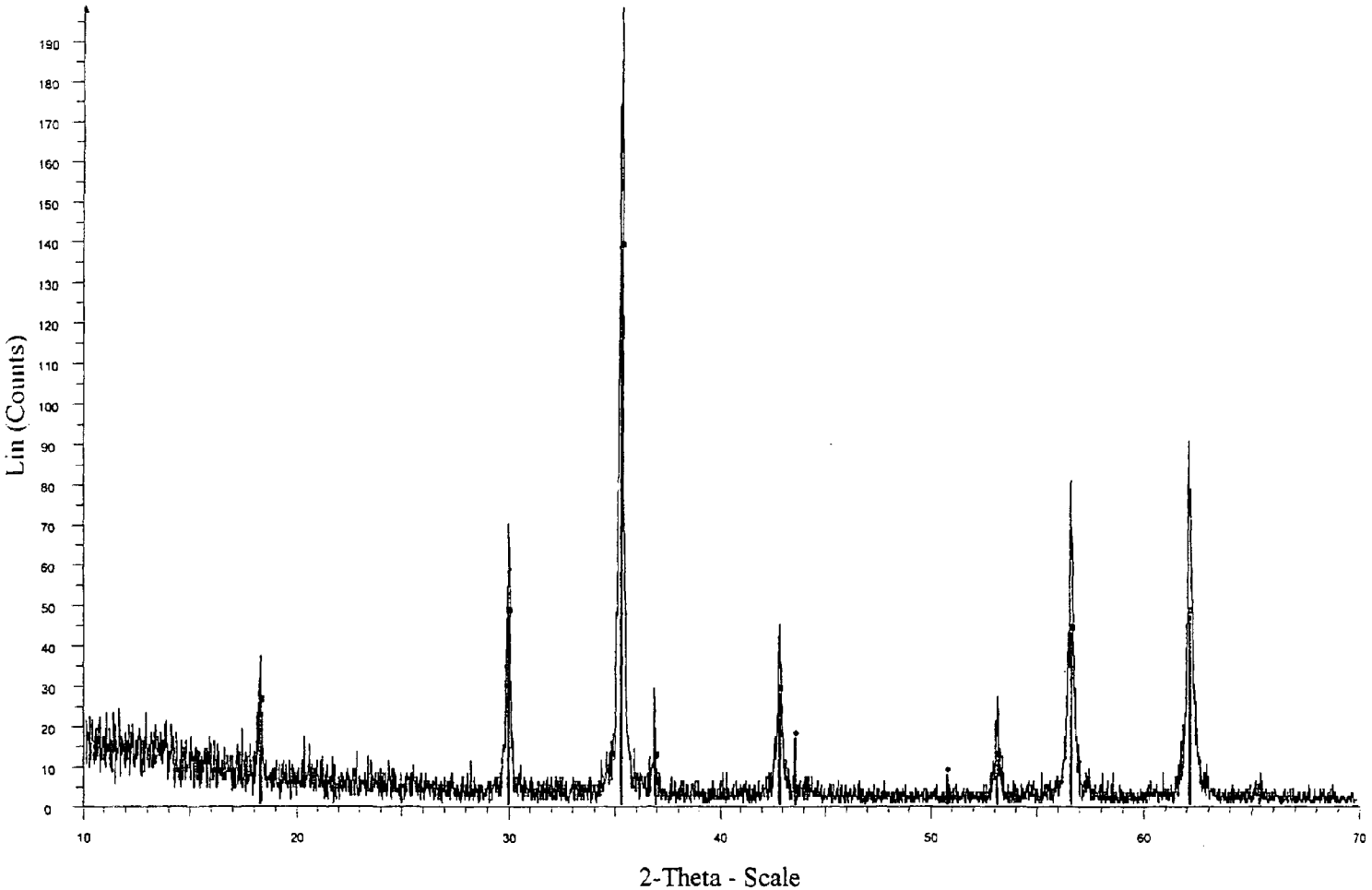
FIG. 2 is the X-ray diffraction spectrum of Example 3.

X-ray diffraction analysis of a composite coating of the present invention on a stainless steel substrate was carried out using a Bruker D8 X-ray diffractometer with a Cu X-ray source and fitted with a Göbel Mirror and glancing incidence capabilities. FIG. 2 is the X-ray diffraction spectrum obtained at 40 KeV, 40 ma, showing the fitted structure of the primary spinel structure $MnCr_2O_4$ of the coating.

EXAMPLE 4

Coking Performance Test Results

Figure 3:
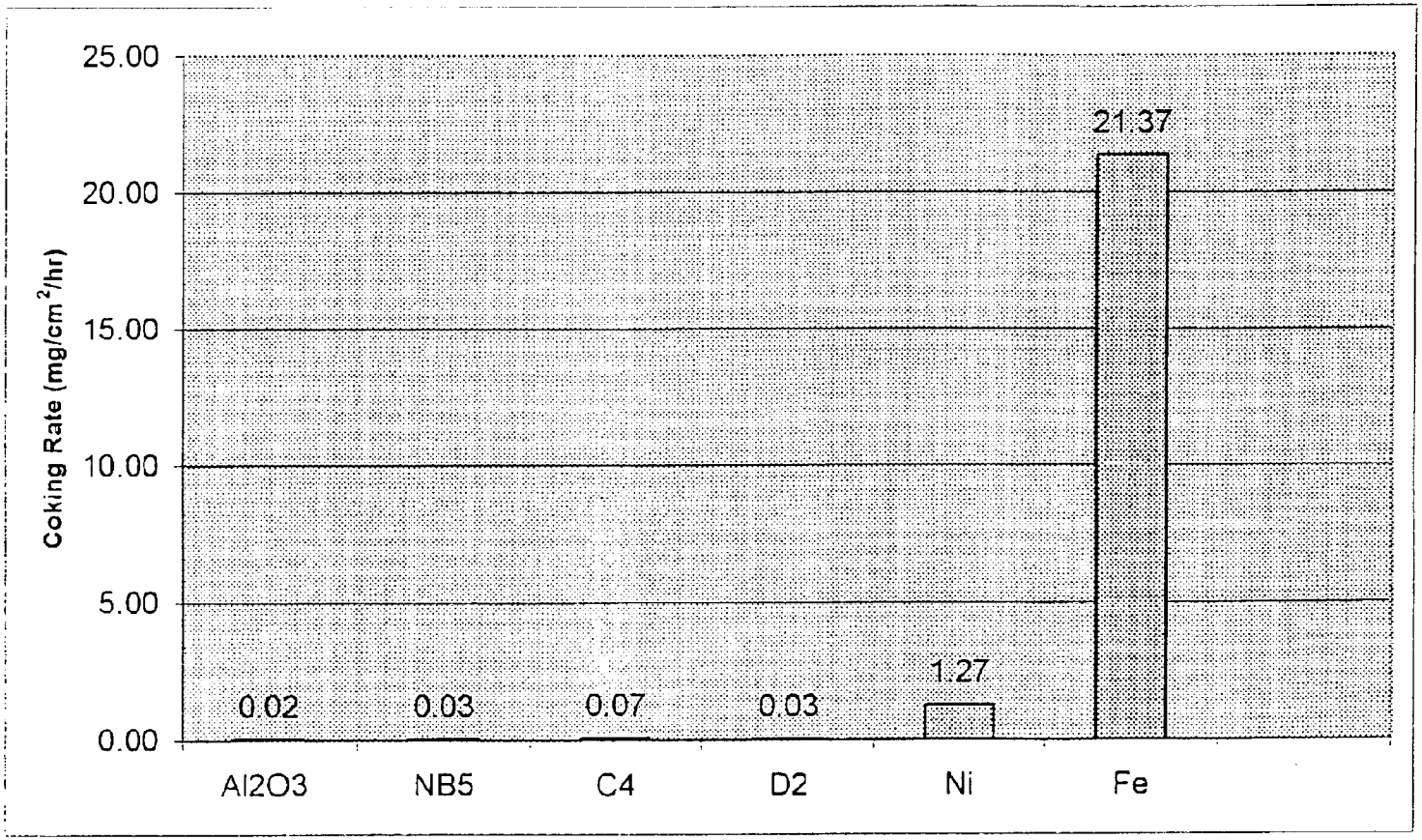
FIG. 3 is a plot of the results from Example 4.

Coking rate performance of coating systems and reference materials was undertaken using a laboratory-scale quartz-reactor. The test provides a relative ranking of the coking propensity of materials under hydrocarbon steam cracking conditions aimed at manufacturing olefins, primarily ethylene. Using ethane as the hydrocarbon feedstock, the test conditions used primarily probe the resistance of a coating or surface to formation of catalyzed coke (also known as filamentous coke). It is well recognized in the literature, that surface species such as Fe and Ni have high propensity for such catalyzed coke-make, whereas, ceramic materials such as alumina are inert. The results are shown in FIG. 3. The test conditions were steam:ethane ratio of 1:3 (wt %) with a reaction temperature of 800° C., a residence time of approximately 2 seconds and a total test duration of 1 hour. The results shown in Table 2 show the excellent resistance to catalytic coke-make of the three coating systems reported in Table 1, compared to a highly inert ceramic material (alumina), and the highly catalytically-active Fe and Ni.

TABLE 2

| Sample | Surface Area ($cm^2$) | Weight Gain (mg) | Coking Rate ($mg/cm^2/hr$) |
|---|---|---|---|
| $Al_2O_3$ - Reference | 4.25 | 0.1 | 0.02 |
| $MnCr_2O_4$ - Based Coating | 3.75 | 0.1 | 0.03 |
| MnO - Based Coating | 2.69 | 0.2 | 0.07 |
| Mn Silicates - Based Coating | 3.00 | 0.1 | 0.03 |
| Ni - Reference | 3.69 | 4.7 | 1.27 |
| Fe - Reference | 3.55 | 75.9 | 21.37 |

What is claimed is:

1. On a steel substrate a surface having a thickness from 10 to 5,000 microns comprising from 40 to 60 weight % of compounds of the formula $Mn_xCr_{3-x}O_4$ wherein x is from 0.5 to 2 and from 60 to 40 weight % of oxides of Mn and Si selected from the group consisting of MnO, $MnSiO_3$, $Mn_2SiO_4$ and mixtures thereof provided that the surface contains less than 5 weight % of $Cr_2O_3$.

2. The surface according to claim 1, in which covers not less than 85% of the surface of the substrate.

3. The surface according to claim 2, having a thickness from 10 to 1,000 microns.

4. The surface according to claim 3, wherein $Cr_2O_3$ is present in an amount of less than 2 weight %.

5. A surface according to claim 4, wherein the substrate is selected from the group consisting of carbon steel, stainless steel, heat resistant steel, HP, HT, HU, HW and HX stainless steel, and nickel or cobalt based HTA alloys.

6. The surface according to claim 5, wherein the substrate comprises from 13 to 50 weight % of Cr and from 20 to 50 weight % of Ni.

7. The surface according to claim 5, wherein the substrate comprises from 50 to 70 weight % of Ni; from 20 to 10 weight % of Cr; from 20 to 10 weight % of Co; and from 5 to 9 weight % of Fe.

8. The surface according to claim 5, wherein the substrate comprises from 40 to 65 weight % of Co; from 15 to 20 weight % of Cr; and from 20 to 13 weight % of Ni; less than 4 weight % of Fe; and up to 20 weight % of W.

9. The surface according to claim 6, wherein the oxide is MnO.

10. The surface according to claim 6, wherein the oxide is $MnSiO_3$.

11. The surface according to claim 6, wherein the oxide is $Mn_2SiO_4$.

12. The surface according to claim 6, wherein the oxides are mixtures of MnO, $MnSiO_3$ and $Mn_2SiO_4$.

13. The surface according to claim 7, wherein the oxide is MnO.

14. The surface according to claim 7, wherein the oxide is $MnSiO_3$.

15. The surface according to claim 7, wherein the oxide is $Mn_2SiO_4$.

16. The surface according to claim 7, wherein the oxides are mixtures of MnO, $MnSiO_3$ and $Mn_2SiO_4$.

17. The surface according to claim 8, wherein the oxide is MnO.

18. The surface according to claim 8, wherein the oxide is $MnSiO_3$.

19. The surface according to claim 8, wherein the oxide is $Mn_2SiO_4$.

20. The surface according to claim 8, wherein the oxides are mixtures of MnO, $MnSiO_3$ and $Mn_2SiO_4$.

21. A method of applying a composition comprising from 40 to 60 weight % of compounds of the formula $Mn_x,Cr_{3-x}O_4$ wherein x is from 0.5 to 2 and from 40 to 60 weight % of oxides of Mn and Si selected from the group consisting of MnO, $MnSiO_3$ and $Mn_2SiO_4$ and mixtures thereof provided that the composition contains less than 5 weight % of $Cr_2O_3$ to at least a portion of a steel substrate comprising applying said composition by a method selected from the group consisting of detonation gun spraying, cement packing, hard facing, laser cladding, plasma spraying, physical vapor deposition methods, flame spraying, and electron beam evaporation to at least 70% of the selected surface of the steel substrate to provide a thickness from 10 to 5,000 microns.

22. The process according to claim 21, in which the composition covers not less than 85% of the selected surface of the substrate.

23. The process according to claim 22, wherein the surface has a thickness from 10 to 1,000 microns.

24. The process according to claim 23, wherein $Cr_2O_3$ is present in an amount of less than 2 weight %.

25. The process according to claim 24, wherein the substrate is selected from the group consisting of carbon steel, stainless steel, heat resistant steel, HP, HT, HU, HW and HX stainless steel, and nickel or cobalt based HTA alloys.

26. The process according to claim 25, wherein the substrate comprises from 13 to 50 weight % of Cr and from 20 to 50 weight % of Ni.

27. The process according to claim 26, wherein the oxide is MnO.

28. The process according to claim 26, wherein the oxide is $MnSiO_3$.

29. The process according to claim 26, wherein the oxide is $Mn_2SiO_4$.

30. The process according to claim 26, wherein the oxides are mixtures of MnO, $MnSiO_3$ and $Mn_2SiO_4$.

31. The process according to claim 25, wherein the substrate comprises from 50 to 70 weight % of Ni; from 20 to 10 weight % of Cr; from 20 to 10 weight % of Co; and from 5 to 9 weight % of Fe.

32. The process according to claim 31, wherein the oxide is MnO.

33. The process according to claim 31, wherein the oxide is $MnSiO_3$.

34. The process according to claim 31, wherein the oxide is $Mn_2SiO_4$.

35. The process according to claim 31, wherein the oxides are mixtures of MnO, $MnSiO_3$ and $Mn_2SiO_4$.

36. The process according to claim 25, wherein the substrate comprises from 40 to 65 weight % of Co; from 15 to 20 weight % of Cr; and from 20 to 13 weight % of Ni, less than 4 weight % of Fe and up to 20 weight % of W.

37. The process according to claim 36, wherein the oxide is MnO.

38. The process according to claim 36, wherein the oxide is $MnSiO_3$.

39. The process according to claim 36, wherein the oxide is $Mn_2SiO_4$.

40. The process according to claim 36, wherein the oxides are mixtures of MnO, $MnSiO_3$ and $Mn_2SiO_4$.

41. A stainless steel pipe or tube having at least a portion of its inner surface comprising a composite surface according to claim 1.

42. A process for the thermal cracking of a hydrocarbon comprising passing said hydrocarbon at elevated temperatures through stainless steel pipe or tube according to claim 41.

43. A stainless steel reactor having at least a portion of its inner surface comprising a composite surface according to claim 1.

44. A process for conducting a chemical reaction in said stainless steel reactor according to claim 43.

45. A stainless steel heat exchanger having at least a portion of its inner surface comprising a composite surface according to claim 1.

46. A process for altering the enthalpy of a fluid comprising passing the fluid through said heat exchanger according to claim 45.

* * * * *